US005522774A

United States Patent [19]

Cardinale et al.

[11] Patent Number: 5,522,774

[45] Date of Patent: Jun. 4, 1996

[54] BOWLING BALL WITH TOP WEIGHT AND CERAMIC CORE

[75] Inventors: Philip J. Cardinale, San Antonio, Tex.; Kenneth C. Whiting, Farmington, Utah; Ron Wood, Las Vegas, Nev.

[73] Assignee: Track, Inc.

[21] Appl. No.: 390,279

[22] Filed: Feb. 15, 1995

Related U.S. Application Data

[63] Continuation of Ser. No. 204,598, Mar. 1, 1994, abandoned.

[51] Int. Cl.[6] ..... A63B 37/04

[52] U.S. Cl. ..... 473/125; 473/126; 273/DIG. 20

[58] Field of Search ..... 473/125, 126; 273/DIG. 20

[56] References Cited

U.S. PATENT DOCUMENTS

| | | | |
|---|---|---|---|
| 3,350,252 | 10/1967 | Twickler | 156/228 |
| 3,400,929 | 9/1968 | Fabanich . | |
| 3,441,274 | 4/1969 | Collins . | |
| 3,591,177 | 7/1971 | Skuse | 273/63 |
| 4,131,277 | 12/1978 | Randolph | 273/63 D |
| 4,183,527 | 1/1980 | Amburgey | 273/63 E |
| 4,328,967 | 5/1982 | Orlando et al. | 273/63 G |
| 4,523,757 | 6/1985 | Swett et al. | 273/63 E |
| 4,655,454 | 4/1987 | Amburgey | 273/63 E |
| 4,802,671 | 2/1989 | Gentiluomo | 473/126 |
| 4,913,429 | 4/1990 | Fabanich | 273/63 E |
| 5,058,901 | 10/1991 | Salvino | 273/63 E |
| 5,098,096 | 3/1992 | Gentiuomo | 273/DIG. 20 |
| 5,215,304 | 6/1993 | Pirel, Jr. et al. | 473/126 |
| 5,238,245 | 8/1993 | Sposato | 473/126 |

OTHER PUBLICATIONS

AMF, "A New Law of Physics Now Applies to Bowling" 1994.

AMF, "The New Ninja Fighting Force", 1993.

*Primary Examiner*—Vincent Millin

*Assistant Examiner*—William M. Pierce

*Attorney, Agent, or Firm*—Donald R. Comuzzi; Christopher L. Makay

[57] ABSTRACT

A bowling ball comprises a dense inner core which cannot be penetrated during the drilling of holes for gripping purposes and balance holes to adjust the static weight, a non-spherical outer core formed about the inner core to act as a top weight, and a cover stock. The dense inner core which cannot be penetrated by a drill prevents the characteristics of the bowling ball from being changed and, further, lowers both the moment of inertia and radius or gyration of the bowling ball to improve the bowling ball's characteristics. These characteristics include enhancing the rolling pattern of the ball and increasing the energy with which the ball strikes the pins. The non-spherical outer core operates as a top weight to replace weight removed during the drilling of the finger and thumb holes and enhance the hooking action of the ball by providing a breakpoint which is very sharp at the back end of the bowling lane. That late, sharp breaking hook allows the bowling ball to strike the pins with a greater force.

2 Claims, 2 Drawing Sheets

BOWLING BALL WITH TOP WEIGHT AND CERAMIC CORE

CROSS-REFERENCE TO RELATED APPLICATIONS

This application is a continuation of application Ser. No. 08/204,598 filed on Mar. 1, 1994 and now abandoned.

BACKGROUND OF THE INVENTION

1. Field of the Invention

The present invention relates to bowling balls and, more particularly, but not by way of limitation, to a bowling ball including an inner core of high density material which cannot be penetrated during the drilling of holes for gripping purposes or balance holes to adjust the static weight.

2. Description of the Related Art

The American Bowling Congress promulgates rules which govern the construction of bowling balls utilized by both amateur and professional bowlers. These rules contain bowling ball specifications which include the composition material of the bowling ball, which must be a non-metallic material, as well as the maximum and minimum circumference and minimum surface hardness of the bowling ball. The American Bowling Congress regulates bowling ball construction to prevent certain bowlers from gaining an unfair advantage through the use of specially designed balls.

The rule promulgated by the American Bowling Congress which allows the most flexibility in bowling ball designs relates to the non-metallic material composition of the ball. That rule provides the greatest flexibility because a variety of different materials may be used to change the performance characteristics of the ball. For example, a ball having a denser core will begin pure rolling on the bowling lane sooner than balls with less dense cores. That performance characteristic creates the desirable effect of reducing the amount of time it takes for the ball to begin spinning on the bowling lane. This increases the amount of revolution a ball achieve while rolling down the lane. A ball that commences pure rolling sooner will transfer more of its kinetic energy to the bowling pins because it loses less energy to friction.

Thus, the composition of the bowling ball becomes extremely important because the above-described rolling characteristic is produced by decreasing the ball's moment of inertia. The ball's moment of inertia is decreased by removing ball weight from the ball's outer portion and placing it in the ball's inner portion. Redistribution of the ball's weight to the center may be accomplished through the use of an inner core of dense material. Unfortunately, the densest materials (i.e., metal-based materials) are illegal due the rules promulgated by the American Bowling Congress. Accordingly, various ball designs and types of dense non-metallic materials have been employed to meet the specifications of the American Bowling Congress, while still providing a low moment of inertia for the ball.

One such bowling ball is disclosed in U.S. Pat. Nos. 4,802,671 and 5,098,096, which were issued on Feb. 7, 1989, and Mar. 24, 1992, respectively, to Gentiluomo. Gentiluomo discloses a bowling ball having a dense, spherical inner core, an annular top weight mass about the inner core, a spherical outer core, and a cover. The dense inner core is provided to increase the moment of inertia of the ball in order to increase the distance the ball travels before it begins uniform rolling motion. The decreased rolling of the Gentiluomo ball decreases the amount of kinetic energy which the ball retains as it travels down the bowling lane. The inner core disclosed in Gentiluomo is made using either a sintering process well known in the ceramic art or by cold pressing bonding resins mixed with powdered ceramics or minerals into a spherical core.

Although the dense inner core provides an improvement in the stabilization of the ball, the spherical construction of both the inner and outer cores creates the control problem of allowing a breakpoint in the path of the ball's travel at a point relatively early along the bowling lane. That is, once the ball begins uniform rolling, any rotation imparted to the ball by the bowler will immediately produce a hook in the ball's path of travel because the spherical shape of both the inner and outer cores provides no counterweight to offset the rotation of the ball. Thus, a consistent hook in the ball's path of travel at the back end of the bowling lane which is essential to scoring well is extremely difficult to achieve. The only way to achieve a late breaking hook is for the bowler to impart a tremendous amount of spin to the ball which defeats the purpose of producing a ball having a low moment of inertia and, further, makes control of the bail extremely difficult. Accordingly, even though the Gentiluomo bowling ball produces improved stabilizing characteristics, its hooking action at a point early along the bowling lane provides less than satisfactory control of the breakpoint and less than satisfactory transfer of energy.

Accordingly, a bowling ball that provides increased kinetic energy by rolling sooner at the front end of the lane while still producing a sharp break at the back end of the lane is highly desirable.

SUMMARY OF THE INVENTION

In accordance with the present invention, a bowling ball comprises a dense non-spherical inner core positioned with its center substantially coincident with the ball's geometric center, a non-spherical outer core surrounding the inner core and positioned within the ball to serve as a top weight, and a cover stock surrounding the inner and outer cores. The inner core is constructed from a material with a sufficient hardness to prevent its being drilled into during the drilling of holes for gripping purposes or balance holes to adjust the static weight. Materials suitable for use as the inner core have a minimum vickers hardness number of 985 kg/mm$^2$ determined using the Vickers Hardness Test and are typically ceramics formed from substances such as aluminum oxide, zirconia, or silicon nitride. The inner core must be of sufficient hardness to prevent its being drilled into during the drilling of holes for gripping purposes or balance holes to adjust the static weight so that the characteristics of the ball cannot be changed.

However, although the characteristics of the ball cannot be easily altered, those characteristics provide a significant improvement over existing balls. First, the extremely dense non-spherical inner core decreases the ball's moment of inertia and radius of gyration in order to impart quicker spinning action to the ball so that it achieves more revolutions sooner while requiring less energy from the bowler. Additionally, the ball will begin rolling at a point nearer to the front end of the lane to permit the ball to retain a greater amount of its kinetic energy than in existing balls.

Furthermore, the non-spherical outer core also enhances the characteristics of the bowling ball. The non-spherical outer core is positioned within the bowling ball to function as a top weight which provides the maximum allowable three ounce out-of-balance between the top and bottom of the ball permitted by the American Bowling Congress. As a top weight, the outer core offsets the loss of weight resulting from the drilling of holes for gripping purposes or balance holes to adjust the static weight and acts a counterweight to initially compensate for the rotation imparted to the ball by the bowler. As the bowling ball travels down the bowling lane, the rotation imparted by the bowler attempts to force the ball to break. However, the non-spherical outer core produces a gyroscopic effect to provide an initial counterbalancing force which holds the bowling ball along its original path of travel. However, as with any gyroscopic effect, the initial counterbalancing force created by the non-spherical outer core reverses to add with the rotation imparted to the ball by the bowler. Consequently, the bowling ball breaks sharply to produce a hook in its path of travel. This hook point is projected further down the lane, thus, improving the angle of entry into the pins. A greater angle of entry is desired because it increases the percentage of strikes.

By initially resisting the rotational forces imparted to the ball by the bowler, the non-spherical outer core produces a large hook at the back end of the bowling lane. Hooking of the ball at the back end of the bowling lane is extremely desirable because it permits maximum ball control and maximum angle of entry while further increasing the kinetic energy of the ball. Thus, the bowling ball not only begins uniform rolling sooner which increases its kinetic energy, but it also produces a hook at the back end of the bowling lane to allow maximum ball control combined with the delivery of maximum kinetic energy to the bowling pins.

In contrast, bowling balls having spherical cores hook at a point earlier along the bowling lane which reduces both bowler control over the ball as well as its striking power due to a decreased angle of entry. Thus, the non-spherical inner and outer cores provide a bowling ball with characteristics such as breakpoint, kinetic energy, and a uniform rolling point which greatly improve over balls containing purely spherical cores.

It is, therefore, an object of the present invention to produce a bowling ball that has a low moment of inertia and radius of gyration.

It is another object of the present invention to produce a bowling ball that has a greater density differential between the cover stock and the cores than in existing bowling balls.

It is a further object of the present invention to provide a bowling ball which begins pure rotation with a quicker spinning action at a point closer to the front end of a bowling ball lane than existing balls.

It is still another object of the present invention to provide a bowling ball which achieves more revolutions while requiring less energy be imparted to the ball by a bowler than in existing balls.

It is still a further object of the present invention to provide a bowling ball with an enhanced rolling pattern with a greater hook at the back end of the bowling lane than in existing balls, thus, increasing the angle of entry.

It is even a further object of the present invention to provide a bowling ball with an inner core which cannot be penetrated during the drilling of holes for gripping purposes or balance holes to adjust the static weight to prevent the removing of density from the inner core.

Still other objects, features, and advantages of the present invention will become evident to those skilled in the art in light of the following.

DETAILED DESCRIPTION OF THE PREFERRED EMBODIMENT

Figure 1:
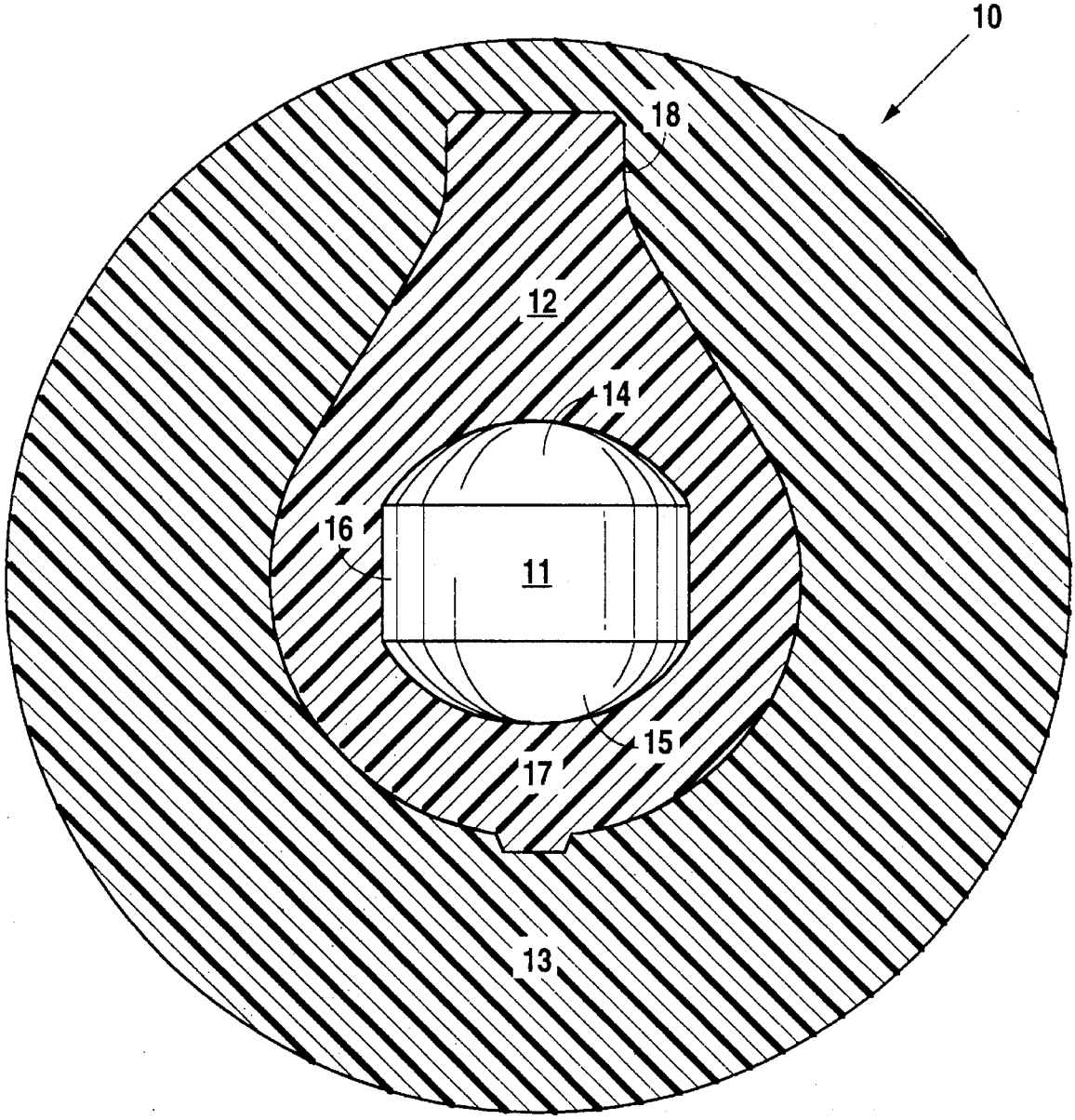
FIG. 1 is a cross-section depicting the inner and outer cores and cover stock of the bowling ball of the present invention.
Figure 2:
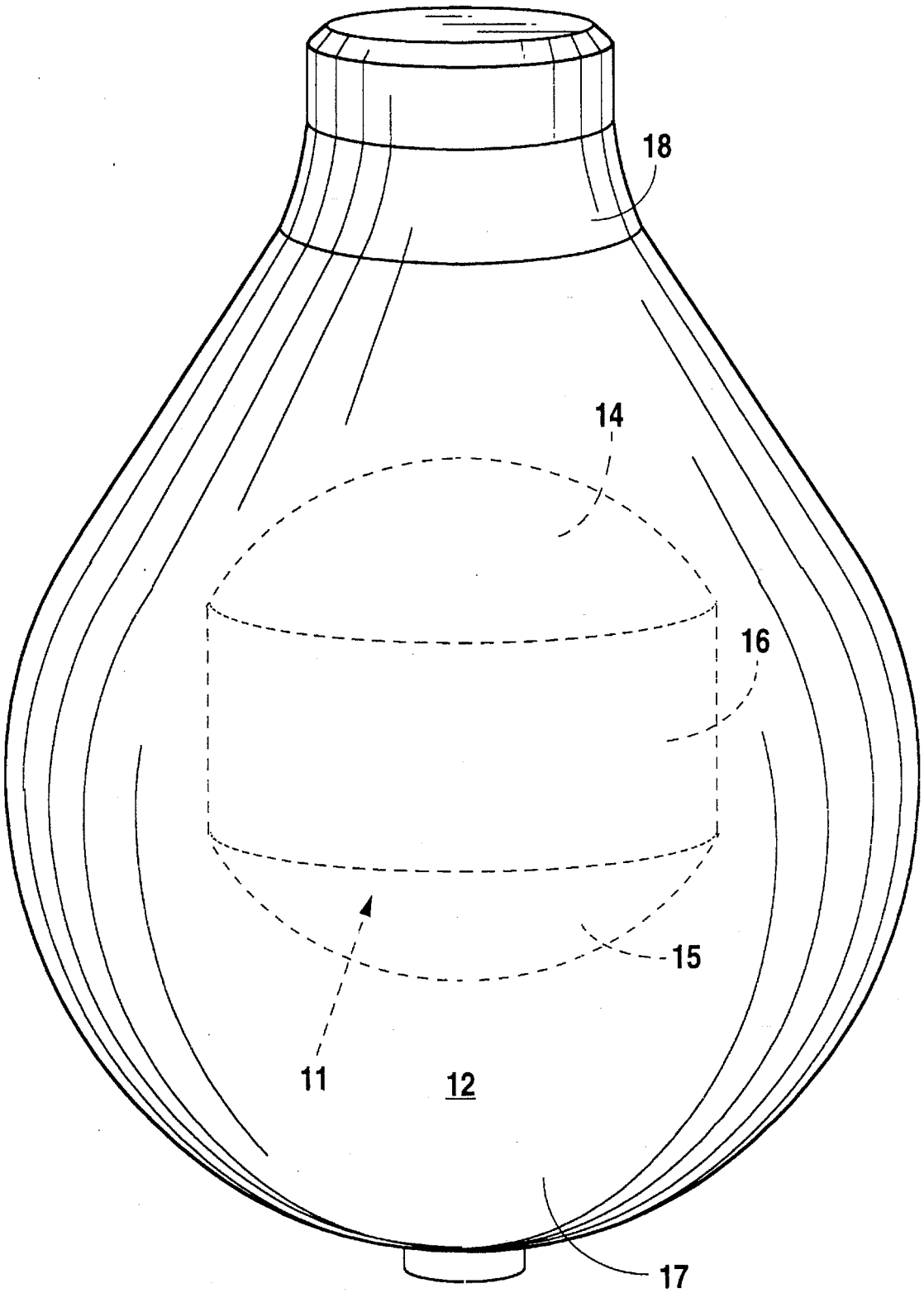
FIG. 2 is perspective view depicting the positioning of the non-spherical inner core within the non-spherical outer core.

Referring to FIGS. 1 and 2, bowling ball 10 comprises inner core 11, outer core 12, and cover stock 13. Inner core 11 comprises spherical portions 14 and 15 which are formed integrally with cylindrical portion 16 to produce a non-spherical design. A high density non-metallic material comprises inner core 11. Materials suitable to form inner core 11 have a minimum vickers hardness hardness of 985 kg/mm$^2$ determined using the Vickers Hardness Test. Such materials include ceramics which are fabricated into the shape depicted in the FIGS. 1 and 2 utilizing any well known ceramic sintering process. Substances suitable for use to produce a ceramic inner core include but are not limited to aluminum oxide, zirconia, and silicon nitride.

Inner core 11 must be an extremely dense material in order to concentrate a greater mass of bowling ball 10 at its center. Accordingly, inner core 11 is positioned with its center substantially coincident with the geometric center of bowling ball 10. Inner core 11 must be a dense, hard material to prevent its penetration during the drilling of holes for gripping purposes or balance holes to adjust the static weight. The inability of a bowling ball user to remove density from the inner core provides bowling ball 10 with extremely uniform lane performance characteristics. Additionally, the denseness of inner core 11 lowers both the radius of gyration and moment of inertia of bowling ball 10 to enhance its rolling pattern and increase its kinetic energy.

Outer core 12 comprises a binding material such as polyester which may be combined with a high density filler such as barium sulfite to produce a dense top weight about inner core 11. Outer core 12 comprises an elongate body having spherical portion 17 which is formed integrally with and terminates at neck portion 18. Outer core 12 is positioned within the bowling ball to provide the maximum allowable three ounce out-of-balance between the top and bottom of bowling ball 10 permitted by the American Bowling Congress. Additionally, the core creates radius of gyration differential between the horizontal and vertical axes of the ball that causes the ball to hook sharply at the back end of the lane thereby increasing the balls angle of entry into the pins. Outer core 12 furnishes bowling ball 10 with top weight which replaces mass in bowling ball 10 removed due to the drilling of holes for gripping purposes or balance holes to adjust the static weight.

Furthermore, the non-spherical design of outer core 12 enhances the characteristics of bowling ball 10 by providing a counterweight which initially compensates for the rotation imparted to bowling ball 10 by a bowler. As bowling ball 10 travels down the bowling lane, the rotation imparted by the bowler attempts to force bowling ball 10 to break. However, outer core 12 produces a gyroscopic effect to provide an initial counterbalancing force which holds bowling ball 10 along its original path of travel. However, as with any gyroscopic effect, the initial counterbalancing force created by outer core 12 reverses to add with the rotation imparted to bowling ball 10 by the bowler. Consequently, bowling ball 10 breaks sharply to produce a hook in its path of travel.

Hooking of bowling ball 10 at the back end of the bowling lane is extremely desirable because it permits maximum ball control while further increasing the kinetic energy of bowling ball. 10. Thus, bowling ball 10 not only begins uniform rolling sooner which increases its kinetic energy, but it also produces a hook at the back end of the bowling lane to allow maximum ball control combined with the delivery of maximum kinetic energy to the bowling pins.

Although outer core 12 has been described as an elongate pear shaped object with a spherical portion 17 terminating in neck 18, any non-spherical shape which will offset weight removed during the drilling of holes for gripping purposes or balance holes to adjust the static weight and provide the maximum allowable three ounce out-of-balance between the top and bottom of bowling ball 10 may be substituted.

Cover stock 13 is comprised of any standard coverstock material such as polyurethane which is presently used to form bowling ball cover stocks. Additionally, the outer surface of cover stock 13 is finished to meet the bowling ball diameter requirements promulgated by the American Bowling Congress.

To construct bowling ball 10, the prefabricated inner core 11 is placed within and supported by a two-section split mold having an inner surface shaped to mirror the shape of outer core 12. The lower section of the split mold includes three pins which support inner core 11 within the mold. After inner core 11 is positioned within the lower section of the mold, the top section of the mold is placed over and to seal the two sections together. Next, the pre-mixed binding material described above is poured into the mold and allowed to harden about inner core 11 to form inner core 11 and outer core 12 as an integral piece.

Although in forming outer core 12 about inner core 11, inner core 11 was supported on three pins, any other suitable support means may be used. For example, inner core 11 could be prefabricated with a hole into which a single pin would fit or inner core 11 could be suspended within the mold for outer core 12 using a monofilament.

After cores 11 and 12 are removed from the mold and outer core 12 allowed to completely harden, a hole is drilled in the top of neck 18 to allow outer core 12 to be supported by a support pin within the spherical cavity of a two-section split mold utilized to form coverstock 13. The mold utilized to form cover stock 13 is a standard mold which creates the spherical shape of cover stock 13. After outer core 12 has been supported within the mold, the coverstock material described above is poured into the mold about outer core 12 to fill the holes in outer core 12 left by the pins from its mold and, further, form the spherical surface of bowling ball 10. Once the coverstock material has hardened, bowling ball 10 is removed from the mold for finishing.

The finishing of bowling ball 10 consists of first filling with coverstock material the hole produced in bowling ball 10 due to the drilling of outer core 12 and the pin of the coverstock mold which resided within the hole in outer core 10. After the hole is filled, coverstock 13 of bowling ball 10 is lathed to meet the bowling ball diameter requirements promulgated by the American Bowling Congress. Once bowling ball 10 is the correct diameter, it is sanded smooth to produce a final finished bowling ball ready for use. The holes for gripping purposes or any balance holes to adjust the static weight may then be drilled, however, inner core 11 cannot be penetrated due to its hardness.

Although the present invention has been described in terms of the foregoing embodiment, such description has been for exemplary purposes only, and, as will be apparent to those of ordinary skill in the art, many alternatives, equivalents, and variations of varying degrees will fall within the scope of the present invention. That scope, accordingly, is not to be limited in any respect by the foregoing description, rather, it is to be defined only by the claims which follow.

We claim:

1. A bowling ball, comprising:

an inner core formed from a material having a minimum hardness of 985 kg/mm to provide said bowling ball with a reduced radius of gyration that enhances the rolling pattern of said bowling ball;

an outer core encapsulating said inner core, said outer core having a non-spherical shape defined by its outer surface to provide top weight that imbalances said bowling ball thereby enhancing the hooking pattern of said bowling ball; and a cover stock formed about said outer core.

2. A bowling ball, comprising:

a ceramic inner core to provide said bowling ball with a reduced radius of gyration that enhances the rolling pattern of said bowling ball;

an outer core encapsulating said ceramic inner core, said outer core having a non-spherical shape defined by its outer surface to provide top weight that imbalances said bowling ball thereby enhancing the hooking pattern of said bowling ball; and a cover stock formed about said outer core.

* * * * *